US006542140B1

(12) United States Patent
Ishigami

(10) Patent No.: US 6,542,140 B1
(45) Date of Patent: Apr. 1, 2003

(54) COLOR LIQUID CRYSTAL DISPLAY AND DISPLAY METHOD THEREOF

(75) Inventor: Masahiro Ishigami, Tokyo (JP)

(73) Assignee: NEC Corporation, Tokyo (JP)

( * ) Notice: Subject to any disclaimer, the term of this patent is extended or adjusted under 35 U.S.C. 154(b) by 260 days.

(21) Appl. No.: 09/630,738

(22) Filed: Aug. 2, 2000

(30) Foreign Application Priority Data

Aug. 10, 1999 (JP) ..... 11/226040

(51) Int. Cl.[7] ..... G09G 3/36

(52) U.S. Cl. ..... 345/88; 345/501; 345/520; 345/533

(58) Field of Search ..... 345/88, 501, 520, 345/531, 533, 545, 547, 549, 440, 530

(56) References Cited

U.S. PATENT DOCUMENTS 4,121,283 A * 10/1978 Walker ..... 364/200
4,991,120 A * 2/1991 Vaiana ..... 364/521
5,155,478 A * 10/1992 Sekiya et al. ..... 340/793

FOREIGN PATENT DOCUMENTS

| | | |
|---|---|---|
| EP | 0 385 449 | 9/1990 |
| EP | 0 464 555 | 1/1992 |
| EP | 0 686 955 | 12/1995 |
| JP | 05-210375 | 8/1993 |
| JP | 07-005870 | 1/1995 |
| JP | 09-179541 | 7/1997 |
| JP | 10-31462 | 2/1998 |
| WO | WO 95/12167 | 5/1995 |

* cited by examiner

*Primary Examiner*—Dennis-Doon Chow
(74) *Attorney, Agent, or Firm*—Young & Thompson

(57) ABSTRACT

A host CPU 1 provides write data corresponding to a color picture to be displayed to a display controller 2. The display controller 2 includes a mode setter 2*a,* a first and a second register 2*b* and 2*c* and a control unit 2*d.* The color picture to be displayed can be reproduced on an LCD 3 by providing read-out data from the display controller 2, in which the write data has been written, to the LCD 3.

15 Claims, 4 Drawing Sheets

COLOR LIQUID CRYSTAL DISPLAY AND DISPLAY METHOD THEREOF

BACKGROUND OF THE INVENTION

The present invention relates to color liquid crystal displays and display method thereof, more particularly, to color liquid crystal displays capable of reproducing a color picture to be displayed on a color liquid crystal display element by providing read-out data from a graphic RAM, in which write data provided from a host CPU or the like is written in correspondence to the color picture, to the color liquid crystal display element.

Color liquid crystal displays are very thin and small size and light in weight and consume very low power compared to color displays using cathod-ray tubes. These displays thus find extensive applications to battery-driven portable devices such as note type personal computers, portable data terminal units and DVD players. The displays find applications not only to battery-driven portable devices but also to installation type large screen displays and monitors. Up to date, this type of displays are in a trend of increasing screen size and reducing price more vigorously than the current cathod-ray tube displays.

Such color liquid crystal displays are different in various aspects from the monochromatic, i.e., white-and-black, liquid crystal displays. In the aspect of the data quantities dealt with by this type of displays, different colors are produced in an optical color addition method using three primary, i.e., red, green and blue, color filters. That is, unlike the monochromatic liquid crystal displays, data quantities of three different colors are dealt with.

Also, the colors which are obtainable by merely combining the three primary colors are only eight in number, which is insufficient for producing a sufficient number of different colors by the optical color addition method. Therefore, the colors which can be displayed should be increased in number by providing gradations in each color. This means the necessity of greater data quantities. For example, 6-bit data is necessary for displaying 64 different colors, and 9-bit data for displaying 512 different colors. At any rate, greater data quantities are necessary compared to the monochromatic binary case of display with one-bit data.

In the meantime, if too long time is taken for reproducing a display picture, it is impossible to reproduce television pictures or like motion pictures, and the commercial value is spoiled. For this reason, in an electronic apparatus using a color liquid crystal display, the display control circuit is required to have fast operation performance compared to an electronic apparatus using a white-and-black (or monochromatic) liquid crystal display. In addition, the fast operation dictates more burdens in view of the power consumption.

In battery-driven personal computers or like electronic devices, more importance is attached to the low power consumption than in electronic devices based on the preamble of operation with AC current of a commercial power supply or the like in home or offices. For this reason, the capacity of various circuits used for the display control and liquid crystal drive is somewhat sacrificed.

Also, most display devices for color liquid crystal display employ elements which are like or similar to the conventional monochromatic liquid crystal display from the consideration of the power consumption reduction.

However, with recent pronounced infra development, environments are becoming more and more adopted to multiple media utilization, and needs of such electronic devices and portable data terminals capable of dealing with color images are increasing. The color liquid crystal displays in such electronic devices should be produced by attaching importance to the power consumption reduction.

The prior art color liquid crystal display as described above is constructed such that it can reproduce a color picture to be displayed on a color liquid crystal display element by providing read-out data from a graphic RAM, in which write data provided from a host CPU or the like is written in correspondence to the color picture, to the color liquid crystal display element. This means that the write data and the read-out data are in one-to-one correspondence relation to each other.

The write data written in the graphic RAM represent different colors and color gradations of individual display pixels, and these data are read out from the graphic RAM and provided to the color liquid crystal display element for reproducing the display color picture thereon.

Therefore, although such a color liquid crystal display gives rise to no problem in case where the individual pixels of the color picture to be displayed have very large numbers of different colors and color gradations as in a color photograph, its function is deemed to be excessive in case where the color picture to be displayed represents worked-out color contents or the like.

Worked-out color contents have only several different colors and also have fewer color gradations. Besides, in this case very large numbers of pixels of the same colors are present. Therefore, writing the same write data in the graphic RAM for each of these pixels leads to extremely great data redundancy.

Since the quantity of the write data written in the graphic RAM and the quantity of the read-out data provided to the color liquid crystal display are substantially the same irrespective of whether the color picture to be displayed have very large numbers of different colors and color gradations as in color photographs or have only several different colors and fewer color gradation as in worked-out color contents, data quantities comparable to the case where very large numbers of different colors and color gradations are present are dealt with in the case of less data quantities as in the display of worked-out color contents, it is impossible to increase the rate of data processing.

SUMMARY OF THE INVENTION

An object of the present invention, therefore, is to provide a color liquid crystal display and display method thereof capable of satisfactorily reproducing a color picture to be displayed when the color picture has very large numbers of different colors and color gradations as in color photographs while also permitting the increase of the rate of data processing when the color picture has fewer different colors and color gradations as in worked-out color contents to alleviate the data processing burdens on the host CPU or the like.

According to an aspect of the present invention, there is provided a color liquid crystal display for reproducing color picture to be displayed on a color liquid crystal display element by providing read-out data from graphic RAM, in which write data provided from a host CPU or the like in correspondence to the color picture has been written, to the color liquid crystal display element, wherein provided is control means capable of selecting a normal write mode, in which pixel data corresponding to a plurality of pixels in the write data are generated such that they each correspond to data of each pixel in the graphic RAM, and a monochromatic write mode, in which pixel data corresponding to the plurality of pixels in the write data are generated such that they can be developed to the data of the plurality of pixels in the graphic RAM.

The control means includes a monochromatic write data register for storing the pixel data corresponding to the plurality of pixels in the write data when the monochromatic write mode is selected and/or a write mode register for storing the pixel data corresponding to the plurality of pixels in the write data when the normal write mode is selected.

The monochromatic write data register stores monochromatic data corresponding to a background color of the color picture to be displayed and other color data than the background color data. The monochromatic write data register stores monochromatic data constituted by color kind data corresponding to a background color of the color picture to be displayed and sequential address data for display according to the color kind data and other color data than the background color data when the monochromatic write mode is selected. The monochromatic write data register stores monochromatic data constituted by color kind data preset for a background color of the color picture to be displayed and sequential address data for display according to the color kind data and other color data than the background color data when the monochromatic write mode is selected.

The control means includes a monochromatic write data register for storing the pixel data corresponding to the plurality of pixels in the write data when the monochromatic write mode is selected, and a write mode register for storing the pixel data corresponding to the plurality of pixels in the write data when the normal write mode is selected, the outputs of the monochromatic write data register and the write mode register being selectively taken out.

The control means does not include the write mode register but includes the monochromatic write data register in the case of a preamble that write data provided from the host CPU or the like in correspondence to the color picture to be displayed is constituted by a small number of different colors.

According to another aspect of the present invention, there is provided display method of a color liquid crystal display for reproducing color picture to be displayed on a color liquid crystal display element by providing read-out data from a memory, in which write data in correspondence to the color picture has been written, to the color liquid crystal display element, wherein a normal write mode, in which pixel data corresponding to a plurality of pixels in the write data are generated such that they each correspond to data of each pixel in the memory, and a monochromatic write mode, in which pixel data corresponding to the plurality of pixels in the write data are generated such that they can be developed to the data of the plurality of pixels in the memory is selected.

The the pixel data corresponding to the plurality of pixels in the write data under the monochromatic write mode is stored in a monochromatic write data register and the pixel data corresponding to the plurality of pixels in the write data under the normal write mode is stored in a write mode register.

Monochromatic data corresponding to a background color of the color picture to be displayed and other color data than the background color data are stored in the monochromatic write data register.

Monochromatic data constituted by color kind data corresponding to a background color of the color picture to be displayed and sequential address data for display according to the color kind data and other color data than the background color data when the monochromatic write mode are stored in the monochromatic write data register.

Monochromatic data constituted by color kind data preset for a background color of the color picture to be displayed and sequential address data for display according to the color kind data and other color data than the background color data when the monochromatic write mode are stored in the monochromatic write data register.

Output of a monochromatic write data register which stores the pixel data corresponding to the plurality of pixels in the write data under the monochromatic write mode, or a write mode register which stores the pixel data corresponding to the plurality of pixels in the write data under the normal write mode is selected.

Other objects and features will be clarified from the following description with reference to attached drawings.

PREFERRED EMBODIMENTS OF THE INVENTION

Preferred embodiments of the present invention will now be described with reference to the drawings. This embodiment of the present invention is an application thereof to the case where "color picture" to be displayed is such that characters and the like are displayed in a predetermined background color.

Figure 1:
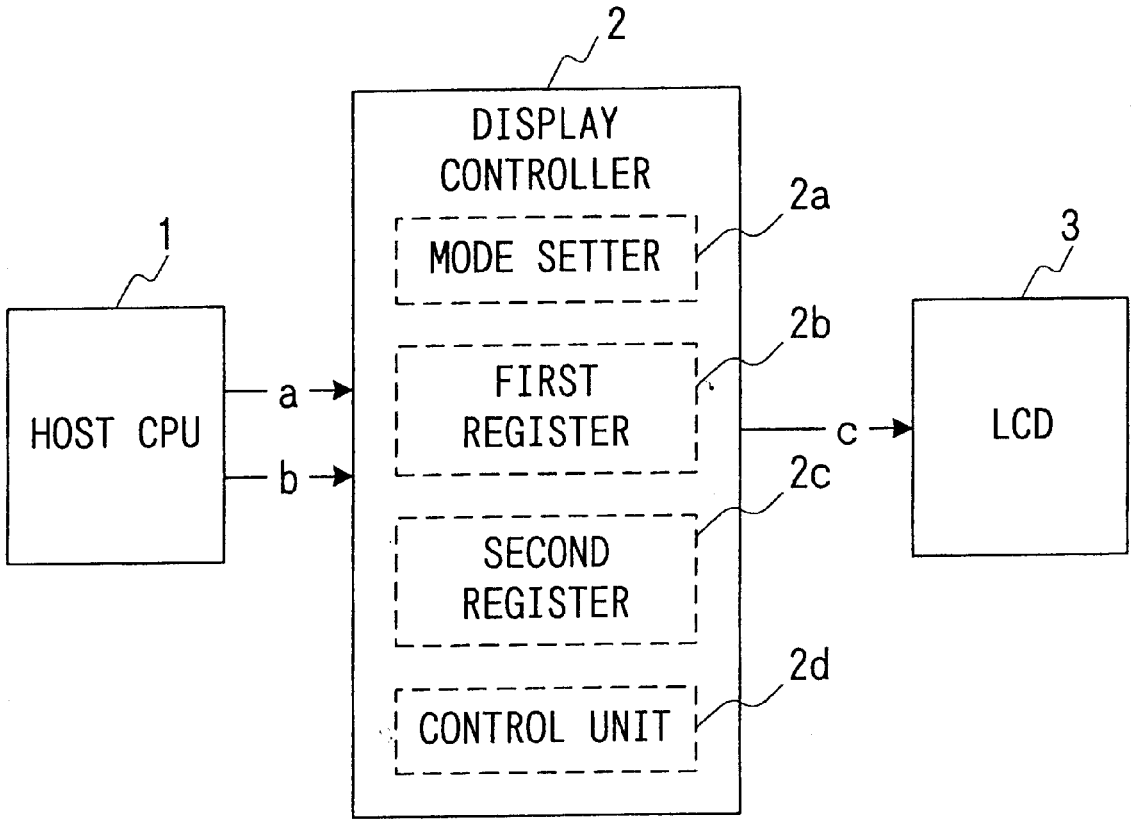
FIG. 1 shows a block diagram of a basic circuit construction of a color liquid display according to an embodiment of the present invention.

Referring to FIG. 1, a host CPU 1 provides "write data", which is constituted by address signal a and data signal b corresponding to the color picture to be displayed, to a display controller 2. The display controller 2 causes reproduction of the color picture to be displayed on a color liquid crystal display element (LCD) 3 by providing read-out data (or read-out signal C) from a graphic RAM, in which the pertinent "write data" has been written, to the LCD 3.

The display controller 2 further constitutes control means capable of selecting a "normal write mode", in which one pixel data corresponding to the "write data" (i.e., address signal a and data signal b) is generated in correspondence to data of each pixel in the graphic RAM in the controller 2, and a "monochromatic write model", in which one pixel data in the "write data" is generated such as to be able to be developed to a plurality of pixel data in the graphic RAM.

The display controller 2 includes a mode setter 2*a* a first and a second registers 2*b* and 2*c* and a control unit 2*d*, and is collectively controlled by the control unit 2*d*. The mode setter 2*a* selects either the "normal write mode" or the "monochromatic write mode" according to the address signal a supplied from the host CPU 1. The first register 2*b* stores data in the "normal write mode", and the second register 2*c* stores data in the "monochromatic write data".

Figure 2:
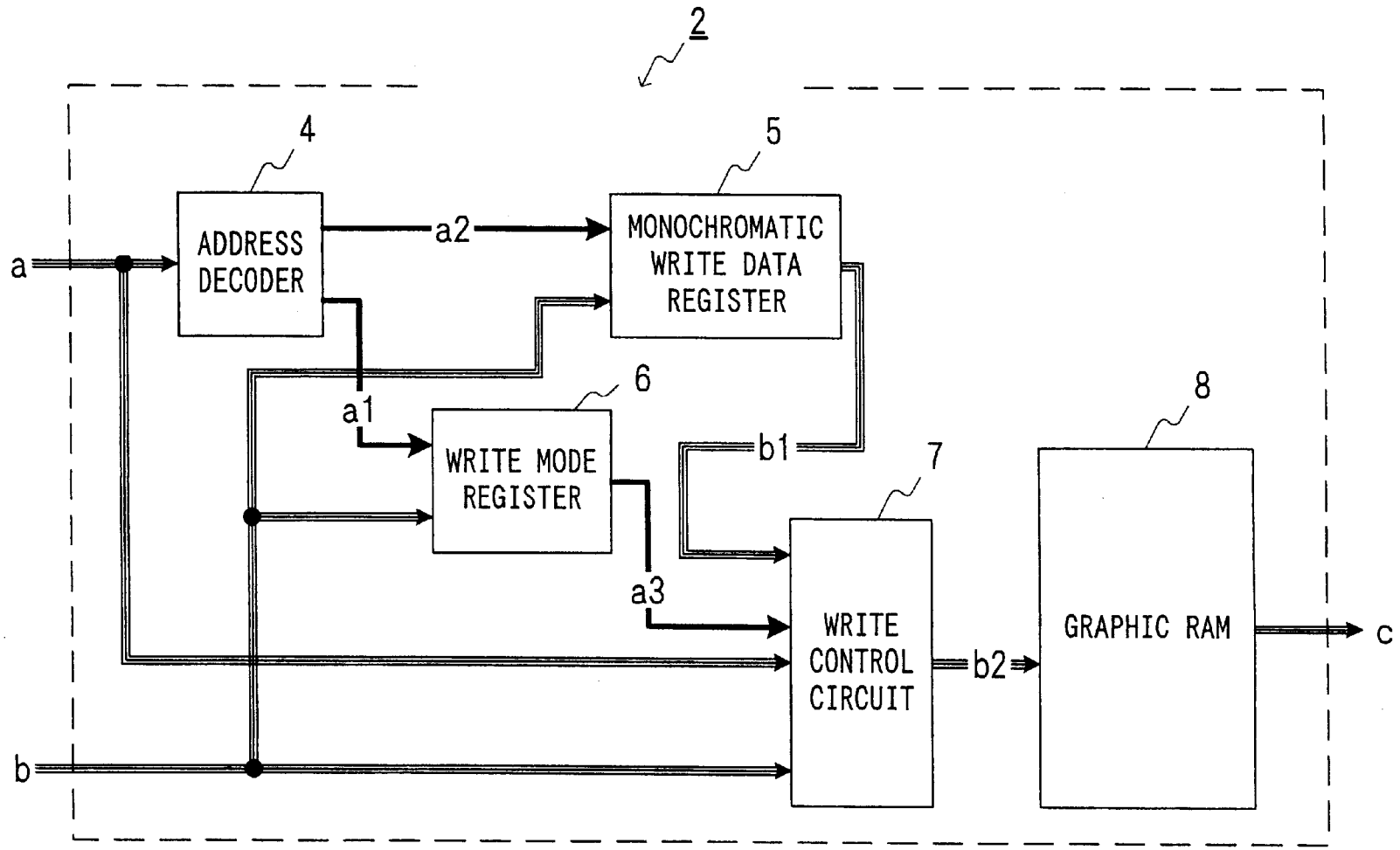
FIG. 2 shows the detailed construction of the display controller 2 in FIG. 1.

FIG. 2 shows the detailed construction of the display controller 2. As shown, the display controller 2 is constituted by an address decoder 4, a monochromatic write data register 5, a write mode register 6, a write control circuit 7 and a graphic RAM 8.

The address decoder 4 is constituted by a usual chip select circuit. When a predetermined address is selected according to the address signal a provided from the host CPU 1 (see FIG. 1), that is, when the "normal write mode" is selected, the address decoder 4 provides a write mode register selection signal a1 to the write mode register 6. When the "monochromatic write mode", is selected, on the other hand, the address decoder 4 provides a monochromatic write mode selection signal a2 to the monochromatic write data register 5. In the monochromatic write data register 5 is set data of a color, in which fast monochromatic write is desired to be performed.

Either the "normal write mode" or the "monochromatic write mode" is instructed as the mode according to the address signal a to the write control circuit 7, which selects a RAM write data signal b2 for the graphic RAM 8.

The graphic RAM 8 instructs the display picture to be displayed on the screen of the LCD 3 (see FIG. 1) by providing a read signal c thereto according to a RAM write data signal b2 provided from the write control circuit 7. Each constituent memory of the graphic RAM 8 thus directly shows each display point (i.e., pixel). The write control circuit 7 accesses each constituent memory of the graphic RAM 8 by selecting normal rate write mode (i.e., normal write mode) designated by the data and address signals b and a or high rate write mode (i.e., monochromatic write mode) utilizing the monochromatic write data register 5 under control of a write mode signal a3 from the write mode register 6.

The address and data signals a and b are bus width multiplex signals determined on the circuit system, and the content of their designation is determined by the address to be accessed for the writing. The monochromatic write mode selection signal a2 which is generated in the address decoder 4, is a signal for selecting the monochromatic write data register 5. Specifically, this signal represents either one of two states, i.e., selection stage and non-selection stage. In other words, the signal represents either one of two modes, i.e., monochromatic write mode and normal write mode. The write mode register selection signal a1 which is also generated in the address decoder 4, is a signal for selecting the write mode register 6. Again this signal represents either one of the two, i.e., selection and non-selection, states or either one of two, i.e., normal write and monochromatic write, modes.

The write mode signal a3 which is generated in the write mode register 6, is a signal for instructing the prevailing write mode to the write control circuit 7. The signal represents either one of two, i.e., monochromatic process and normal process, states or two, i.e., monochromatic write and normal write, modes.

The monochromatic data signal b1 which is held in the monochromatic write data register 5, is color data used when high rate monochromatic writing is performed, and is constituted by a plurality of bits. The RAM write data signal b2 which is generated in the write control circuit 7, is drawing data for writing in the graphic RAM 8, and is constituted by a plurality of bits.

Figure 3:
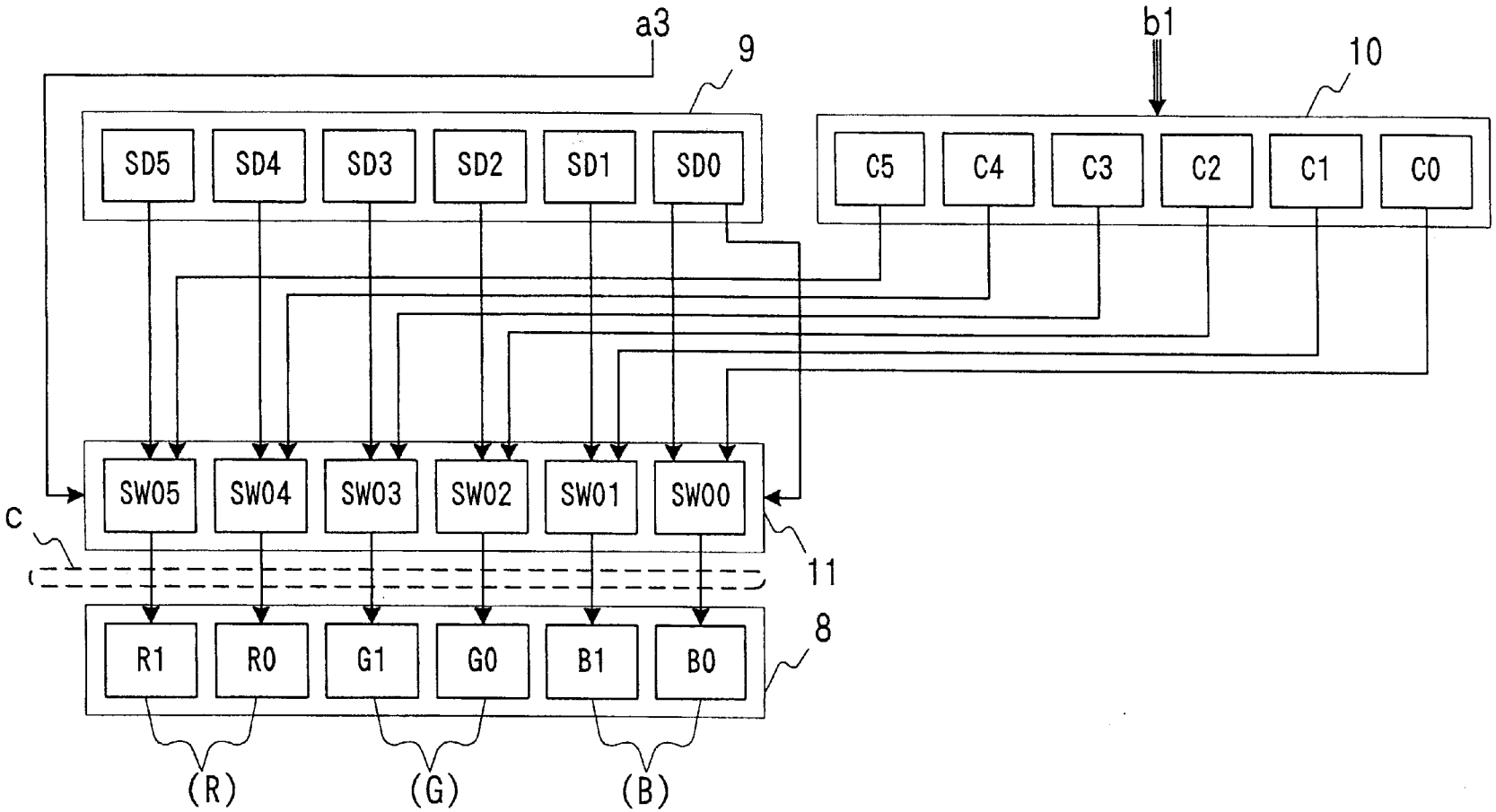
FIG. 3 shows in detail the write control circuit 7 and the graphic RAM 8 shown in FIG. 2.

The constitution of the display controller 2 in the color liquid crystal display will now be described in greater details with reference of FIG. 3. FIG. 3 shows in detail the write control circuit 7 and the graphic RAM 8 shown in FIG. 2. In the graphic RAM 8 shown in FIG. 3, each display point (or pixel) is constituted by a group of 6 bits. The bits represent elements R0 and R1 corresponding to red (R), elements G0 and G1 corresponding to green (G) and elements B0 and B1 corresponding to blue (B) in the three primary colors. In this embodiment, a 64-color liquid crystal display is assumed.

In the color liquid crystal display, one display point (or pixel) is represented by using a combination of the light transmittances of three primary color filters to red, green and blue light fluxes. Also, the reproduction color is determined by a combination of the intensities of the red, green and blue light fluxes. Since the red, green and blue (i.e., R, G abd B) colors are individually constituted by two bits, i.e., elements R0 and R1, elements G0 and G1 and elements B0 and B1, four density gradations are provided for each color. This means that it is possible to reproduce 43, i.e., 64, different colors.

For the color reproduction, the display controller 2 drives the LCD 3 according to the color data that are set in the graphic RAM 8. The construction of the display controller 2 varies with the number of display colors. The construction, however, is mostly the same except for the difference of the register construction corresponding to each display point (or pixel).

Now, the procedure of setting of display data from the host CPU 1 to the graphic RAM 8 will be described. The write mode register 6 in FIG. 2 is set to be in normal processing mode under control of a signal from the host CPU 1. At this time, no data need be set in the monochromatic write data register 5.

The description will now be made in greater details with reference to FIG. 3. A signal selection switch 11 which is constituted by a plurality of switches SW00 to SW05, selects the outputs of a data bus latch 9 and a monochromatic write data latch 10 as data signal sources under control of the write mode signal a3. The data bus and monochromatic write data latches 9 and 10 are 6-bit latches having registers SD0 to SD5 and C0 to C5, respectively for latching and providing signal from the external circuitry. Specifically, the data bus latch 9 latches and provides the data bus signal from the host CPU 1, and the monochromatic write data latch 10 latches and provides the monochromatic data signal b1.

In the case of the normal write mode, the write mode signal a3 is in its normal processing logic, and the data bus latch 9 is selected. Thus, the writing of data from the host CPU 1 in the graphic RAM 8 is performed directly as one display point (or pixel). In view of the rate of writing, the write mode is previously set, and one display point is drawn in one write cycle of the host CPU 1.

The procedure in the monochromatic write mode will now be described. For the monochromatic writing, the write mode register 6 shown in FIG. 2 is set to be in the monochromatic processing mode, and data of desired color of writing is set in the monochromatic write data register 5 under control of the host CPU 1. The color bit array in the monochromatic write data register 5 is like the array in the graphic RAM 8 shown in FIG. 3.

In greater details, in this mode the write mode signal a3 shown in FIG. 3 is in monochromatic processing logic, and the monochromatic write data latch 10 is selected. The signal selection switch 11 controls the writing of data in the graphic RAM 8 according to the signal logic shown by the register SD0 in the data bus latch 9.

The register SD0 represents the 1-st bit of the data bus latch 9, and is assigned to the elements R0, R1, G0, G1, B0 and B1 in the graphic RAM 8. Regarding the entire graphic RAM 8, the assignment is performed in combination with the address signal a shown in FIG. 3 and in units of pages defined by the data bus width as unit.

When the logic of the register SD0 of the data bus latch 9 is "1", the signal selection switch 11 is controlled such as to write signal of the monochromatic write data latch 10 in the graphic RAM 8.

When the logic of the register SD0 of the data bus latch 9 is "0", the signal selection switch 11 is controlled such as not to write any signal of the monochromatic write data latch 10 in the graphic RAM 8. At this time, the signal of the data bus latch 9 is not written, but the writing is merely skipped. This is based on a concept that the color substitution is performed only at necessary display points in a state that the background color is preliminarily initialized to a uniform color.

Figure 4:
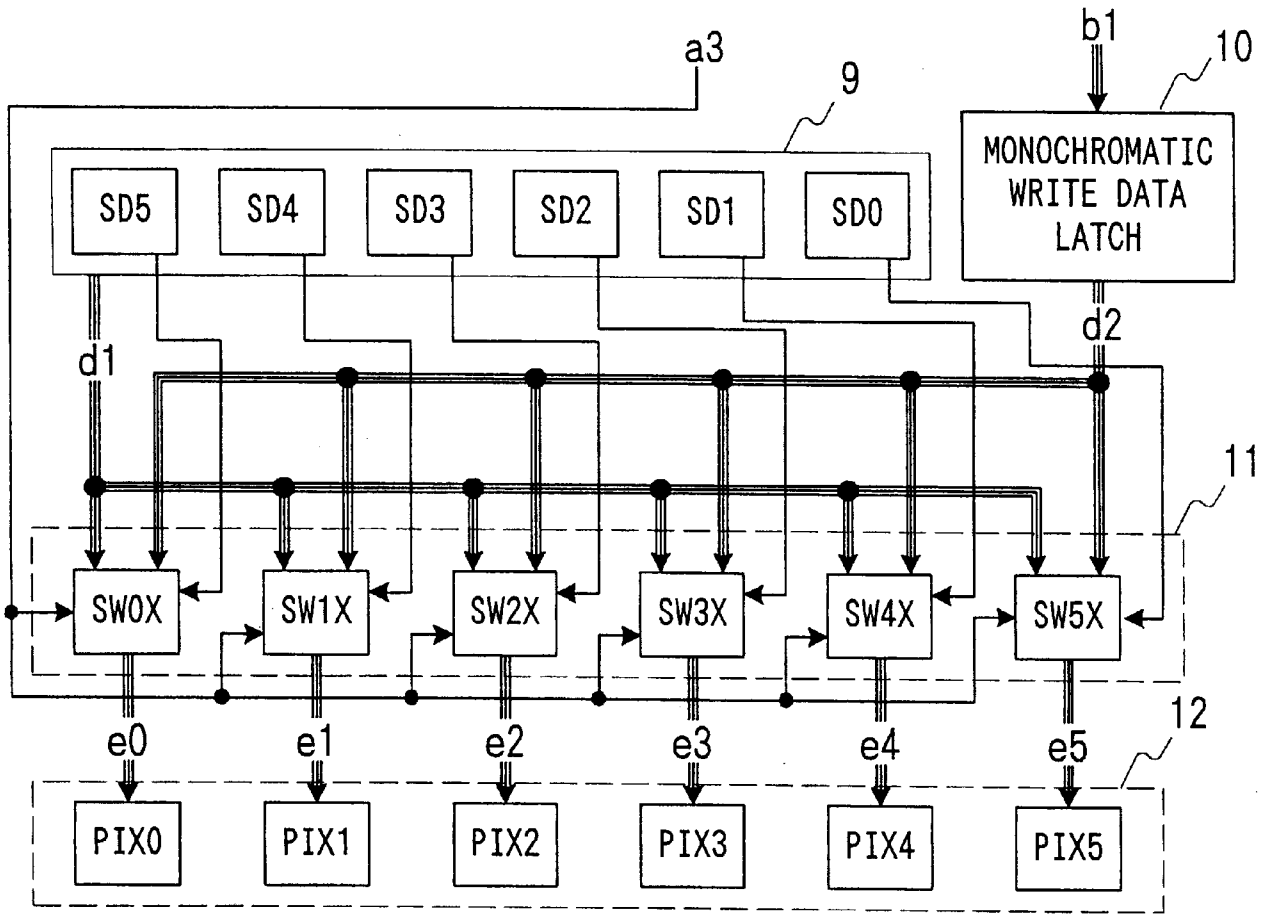
FIG. 4 is a view expressing the unit shown in FIG. 3 in page units of the graphic RAM 8.

FIG. 4 is a view expressing the unit shown in FIG. 3 in page units of the graphic RAM 8. In this case, the signal selection switch 11, like the switch 11 shown in FIG. 3, has 6 parallel switches SW0X to SW5X. The functions of the switches SW0X to SW5X are alike. In this case, a graphic RAM is provided, which has six parallel registers PIX0 to PIX5 conforming to the page. The difference resides in the connection of these registers PIX0 to PIX5 to the registers SD0 to SD5 in the data bus latch 9.

The signal selection switch 11 provides data e0 to e5 to the registers PIX0 to PIX5 of the graphic RAM 12, respectively. As these data, data d1 from the data bus latch 9 and data d2 from the monochromatic write data latch 10 are provided through the switches SW0X to SW5X, which are controlled by the write mode signal a3.

Thus, the host CPU 1 (see FIG. 1) generates signals determining as to whether writing of data in the registers PIX0 to PIX5 in the graphic RAM 12 in units of pages is to be performed to the data bus in correspondence to the bit data. Thus, data is written directly from the host CPU 1 as six display points in the graphic RAM 12. In view of the rate of writing, under the assumption that the write mode is preset the host CPU 1 draws six display points in one write cycle.

While a preferred embodiment of the color liquid crystal display according to the present invention has been described, it is given merely as an example, and various changes and modifications are of course possible in dependence on specific applications.

For example, while in the above embodiment the pixels are constituted in units of six bits, the bit width is usually constituted by a multiple of 8, and it is thus also possible to constitute the pixels such as to be in conformity to this bit width. In this case, it is possible to increase the rate of writing in proportion to the data bus width (or length).

Also, while it has been described that in the monochromatic write mode only colors of necessary display points are changed under the preamble that background color is preliminarily set to be uniform, by providing an additional set of the monochromatic write data register 5 and the monochromatic write data latch 10 like those as shown in FIG. 3 or 4, it is possible to dispense with the preliminary background color processing by dealing with the additional register as background color register when the bit of the register SD0 in the data bus latch 9 is "0" and setting data from the pertinent background color register when the bit of the register SD0 is "1".

Furthermore, under the preamble that write data provided from the host CPU or the like in correspondence to the color picture to be displayed is constituted by a small number of colors, it is of course possible to provide the monochromatic write data register without (i.e., by dispensing with) the write mode register.

As has been described in the foregoing, according to the present invention it is possible to provide a color liquid crystal display, which, in case where the display picture involves very large numbers of different colors and color gradations as in color pictures, can satisfactorily reproduce these colors and color gradations and, in case the display color picture has smaller numbers of colors and color gradations as color contents, can reduce the capacity of data transfer to the graphic RAM or like memory, speedify the accompanying data processing and alleviate the burden of the host CPU or the like in the data processing.

Changes in construction will occur to those skilled in the art and various apparently different modifications and embodiments may be made without departing from the scope of the present invention. The matter set forth in the foregoing description and accompanying drawings is offered by way of illustration only. It is therefore intended that the foregoing description be regarded as illustrative rather than limiting.

What is claimed is:

1. A color liquid crystal display for reproducing color picture to be displayed on a color liquid crystal display element by providing read-out data from graphic RAM, in which write data provided from a host CPU in correspondence to the color picture has been written, to the color liquid crystal display element, wherein provided is control means capable of selecting a normal write mode, in which pixel data corresponding to a plurality of pixels in the write data are generated such that they each correspond to data of each pixel in the graphic RAM, and a monochromatic write mode, in which pixel data corresponding to the plurality of pixels in the write data are generated which are then developed to the data of the plurality of pixels in the graphic RAM.

2. The color liquid crystal display according to claim 1, wherein the control means includes a monochromatic write data register for storing the pixel data corresponding to the plurality of pixels in the write data when the monochromatic write mode is selected.

3. A color liquid crystal display for reproducing color picture to be displayed on a color liquid crystal display element by providing read-out data from graphic RAM, in which write data provided from a host CPU in correspondence to the color picture has been written, to the color liquid crystal display element, wherein provided is control means which is capable of selecting a normal write mode, in which pixel data corresponding to a plurality of pixels in the write data are generated such that they each correspond to data of each pixel in the graphic RAM, and a monochromatic write mode, in which pixel data corresponding to the plurality of pixels in the write data are generated which are then developed to the data of the plurality of pixels in the graphic RAM and includes a write mode register for storing the pixel data corresponding to the plurality of pixels in the write data when the normal write mode is selected.

4. The color liquid crystal display according to claim 3, wherein the monochromatic write data register stores monochromatic data corresponding to a background color of the color picture to be displayed and other color data than the background color data.

5. The color liquid crystal display according to claim 3, wherein the monochromatic write data register stores monochromatic data constituted by color kind data corresponding to a background color of the color picture to be displayed and sequential address data for display according to the color kind data and other color data than the background color data when the monochromatic write mode is selected.

6. The color liquid crystal display according to claim 3, wherein the monochromatic write data register stores monochromatic data constituted by color kind data preset for a background color of the color picture to be displayed and sequential address data for display according to the color kind data and other color data than the background color data when the monochromatic write mode is selected.

7. The color liquid crystal display according to claim 1, wherein the control means includes a monochromatic write data register for storing the pixel data corresponding to the plurality of pixels in the write data when the monochromatic write mode is selected, and a write mode register for storing the pixel data corresponding to the plurality of pixels in the write data when the normal write mode is selected, the outputs of the monochromatic write data register and the write mode register being selectively taken out.

8. The color liquid crystal display according to claim 1, wherein the control means does not include the write mode register but includes the monochromatic write data register in the case of a preamble that write data provided from the host CPU or the like in correspondence to the color picture to be displayed is constituted by a small number of different colors.

9. Display method of a color liquid crystal display for reproducing color picture to be displayed on a color liquid crystal display element by providing read-out data from a memory, in which write data in correspondence to the color picture has been written, to the color liquid crystal display element, wherein a normal write mode, in which pixel data corresponding to a plurality of pixels in the write data are generated such that they each correspond to data of each pixel in the memory, and a monochromatic write mode, in which pixel data corresponding to the plurality of pixels in the write data are generated which are then developed to the data of the plurality of pixels in the memory is selected.

10. The display method according to claim 9, wherein the pixel data corresponding to the plurality of pixels in the write data under the monochromatic write mode is stored in a monochromatic write data register.

11. A display method of a color liquid crystal display for reproducing color picture to be displayed on a color liquid crystal display element by providing read-out data from a memory, in which write data in correspondence to the color picture has been written, to the color liquid crystal display element, wherein a normal write mode, in which pixel data corresponding to a plurality of pixels in the write data are generated such that they each correspond to data of each pixel in the memory, and a monochromatic write mode, in which pixel data corresponding to the plurality of pixels in the write data are generated which are then developed to the data of the plurality of pixels in the memory is selected and the pixel data corresponding to the plurality of pixels in the write data under the normal write mode is stored in a write mode register.

12. The display method according to claim 11, wherein monochromatic data corresponding to a background color of the color picture to be displayed and other color data than the background color data are stored in the monochromatic write data register.

13. The display method according to claim 11, wherein monochromatic data constituted by color kind data corresponding to a background color of the color picture to be displayed and sequential address data for display according to the color kind data and other color data than the background color data when the monochromatic write mode are stored in the monochromatic write data register.

14. The display method according to claim 11, wherein monochromatic data constituted by color kind data preset for a background color of the color picture to be displayed and sequential address data for display according to the color kind data and other color data than the background color data when the monochromatic write mode are stored in the monochromatic write data register.

15. The display method according to claim 9, wherein output of a monochromatic write data register which stores the pixel data corresponding to the plurality of pixels in the write data under the monochromatic write mode, or a write mode register which stores the pixel data corresponding to the plurality of pixels in the write data under the normal write mode is selected.

* * * * *